US007413033B2

(12) United States Patent
Tjader

(10) Patent No.: US 7,413,033 B2
(45) Date of Patent: Aug. 19, 2008

(54) DIRECTIONAL DRILL HEAD

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 270 days.

(21) Appl. No.: 11/283,407

(22) Filed: Nov. 18, 2005

(65) Prior Publication Data

US 2006/0131077 A1 Jun. 22, 2006

Related U.S. Application Data

(60) Provisional application No. 60/629,815, filed on Nov. 19, 2004.

(51) Int. Cl.
*E21B 7/04* (2006.01)

(52) U.S. Cl. ..... 175/75; 175/393

(58) Field of Classification Search ..... None
See application file for complete search history.

(56) References Cited

U.S. PATENT DOCUMENTS 6,390,087 B1 * 5/2002 Wentworth et al. ..... 125/19

* cited by examiner

*Primary Examiner*—Zakiya W. Bates
(74) *Attorney, Agent, or Firm*—Schwegman, Lundberg & Woessner, P.A.

(57) ABSTRACT

A drill head is shown that provides improved steering in difficult ground conditions such as dry and compacted soil. A drill head is shown with features that include a narrow front portion, a sharp hardened insert such as a carbide point, and a curved rear portion of the drill head. Angled porting of liquid is included in selected configurations of the drill head. Porting of liquid within a recess portion is included in selected configuration of the drill head.

19 Claims, 4 Drawing Sheets

DIRECTIONAL DRILL HEAD

This patent application claims the benefit of priority, under 35 U.S.C. Section 119(e), to U.S. Provisional Application Ser. No. 60/629,815, filed on Nov. 19, 2004, which is incorporated herein by reference.

TECHNICAL FIELD

This invention relates to ground drilling equipment. Specifically, this invention relates to drill head designs for horizontal directional drilling devices.

BACKGROUND

Directional drilling is a useful technique for several procedures such as utility installation, etc. One common type of directional drilling is horizontal directional drilling, where a drill stem is extended essentially horizontally to form passages under structures such as roads for example. Drill heads in directional drilling typically have a feature which causes the drill head to steer in one direction when forced ahead by a drilling device. During a boring operation, pressure is applied through a drill stem from behind to the drill head. During a straight bore, the drill stem is typically rotated at a regular rate so that on average, only straight ahead drilling is accomplished. In order to steer a drill head, the rotation is temporarily stopped, and the drill head is allowed to steer in the desired direction. Once the steering maneuver is complete, the drill head is again rotated at a regular rate for straight ahead drilling.

There are numerous types of ground and soil conditions that affect performance of drill heads. As a result, there are numerous designs of drill heads to match each ground type. One difficult type of ground includes tightly packed and dry gravelly soil. One example of this type of ground can be found in southern California. This type of ground is difficult because current drill head designs do not make sufficient forward progress to turn the drill stem when they are not being rotated. This makes steering in such conditions difficult. Although this ground type is used as an example, embodiments of the following invention are not limited to use in such conditions.

What is needed is a drill head and drill assembly with improved steering and improved performance under various ground conditions including, but not limited to dry tightly packed soil.

DETAILED DESCRIPTION

Figure 1A:
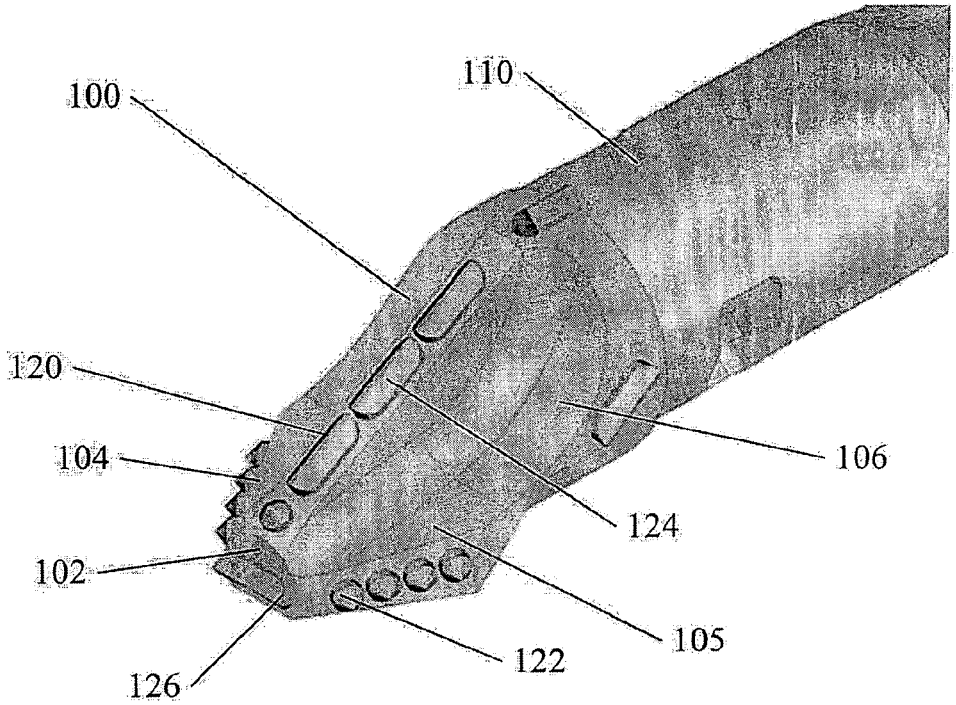
FIG. 1A shows an isometric view of a drill assembly according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention. In the following descriptions, a drill stem is defined to include any component that is advanced from a drilling device. A drill rod is defined as a section of pipe, solid material, etc. where sections of drill rod are coupled together to form a main part of a drill stem. Various drill stem components such as a drill head, a sonde housing, etc. can be attached to the front end of a number of drill rods during one embodiment of a typical drilling operation.

FIG. 1A shows a drill head 100 coupled to a sonde housing 110. In one embodiment, a main portion of the drill head 100 is formed from a tool steel, although other materials are within the scope of the invention. A number of hardened inserts 120 are included in one embodiment, attached at various locations of the drill head 100. In one embodiment, the hardened inserts 120 include tungsten carbide inserts. In one embodiment, a number of conical inserts 122 are shown on side surfaces 104. In one embodiment, a number of elongated inserts 124 are shown on surfaces such as a top surface of the drill head 100. A leading insert 126 is shown on a front portion 102 of the drill head 100. Although particular shapes of inserts are discussed, one of ordinary skill in the art, having the benefit of the present disclosure will recognize that various shapes and combinations of inserts are effective and within the scope of the invention.

In one embodiment, the side surfaces 104 taper down in a front of the drill head 100 to a narrow front portion 102. In one embodiment, a narrow front portion 102 provides an advantage, allowing deeper penetration into difficult ground conditions during a steering operation. In one embodiment, the leading insert 126 further enhances deep penetration into difficult ground conditions.

A flat portion 105 is also shown, leading into a curved portion 106 of the drill head 100. In one embodiment, the flat portion 105 facilitates penetration and engagement into difficult ground conditions. After the flat portion 105 engages the ground with improved penetration as a result of the low angle of incidence, the curved portion 106 facilitates steering of the drill head 100.

Figure 1B:
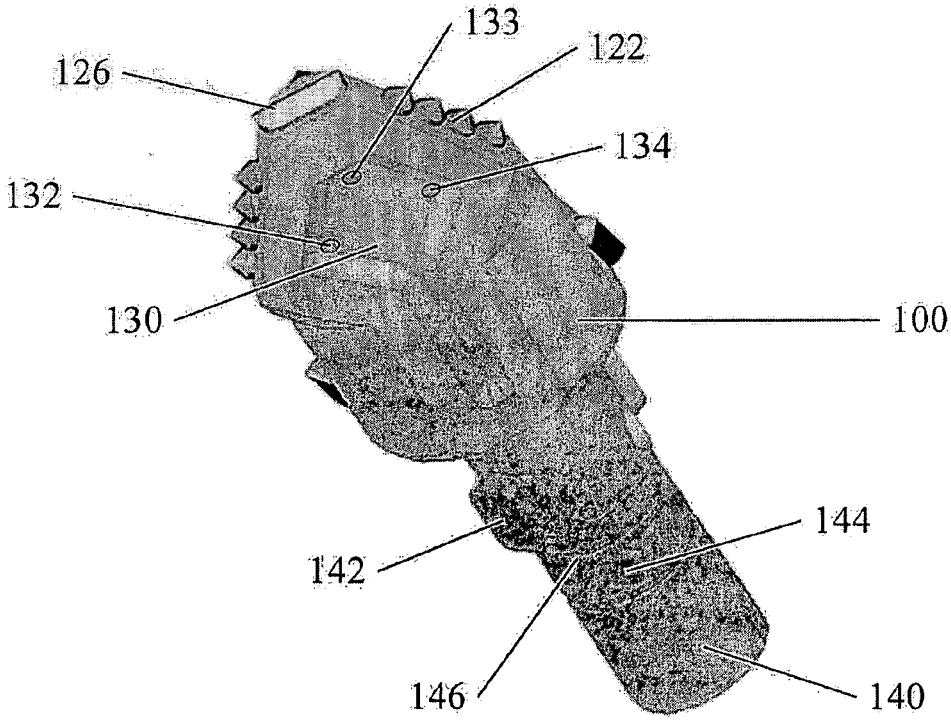
FIG. 1B shows a bottom isometric view of a drill head according to an embodiment of the invention.

FIG. 1B shows a bottom view of the drill head 100. A recess 130 is visible in FIG. 1B. In one embodiment, a first liquid port 132, a second liquid port 133, and a third liquid port 134 are included within the recess 130. In one embodiment, a number of liquid ports are used to provide a large volume of liquid flow over a large surface area such as the area within the recess 130. As shown in FIG. 1B, the liquid ports are located on a bottom portion of the drill head 100. In one embodiment, one or more of the liquid ports 132, 133, 134 include a flow direction that is not parallel with a forward drilling direction. In one embodiment, one or more of the liquid ports 132, 133, 134 include a flow direction that is substantially perpendicular to the forward drilling direction. An advantage of locating liquid ports on a side of the drill head 100 includes increased steering ability. When liquid, such as water, bentonite slurry, or other fluid is ported from one side of the drill head 100, difficult ground material is washed away on only one side of the drill head. This effect tends to create a pocket in the ground, and facilitates steering of the drill head during a drilling operation. In one embodiment, porting liquid over a large surface area with a number of ports enhances this effect, and promotes steering.

In one embodiment, having a flow direction that is not parallel with a forward drilling direction further enhances the creation of a pocket, thus improving steering. In one embodiment, locating one or more of the liquid ports 132, 133, 134 within a recess 130 enhances flow of the liquid and further enhances the creation of a pocket, thus improving steering.

FIG. 1B further shows one embodiment that includes a number of engaging features 142. In one embodiment, the engaging features 142 are used to attach the drill head 100 to other components of a drill stem. In one embodiment, the engaging features 142 are used to couple to a sonde housing. Although engaging features for a quick connect style connection are shown, the invention is not so limited. Other connection configurations are also within the scope of the invention. For example, in one embodiment, a tapered thread connection is used.

A pair of O-ring grooves 146 are further shown with a port 144 between the grooves. In one embodiment, liquid enters the port 144 during a drilling operation and exits through the liquid ports 132, 133, 134 as discussed in selected embodiments above.

Figure 2:
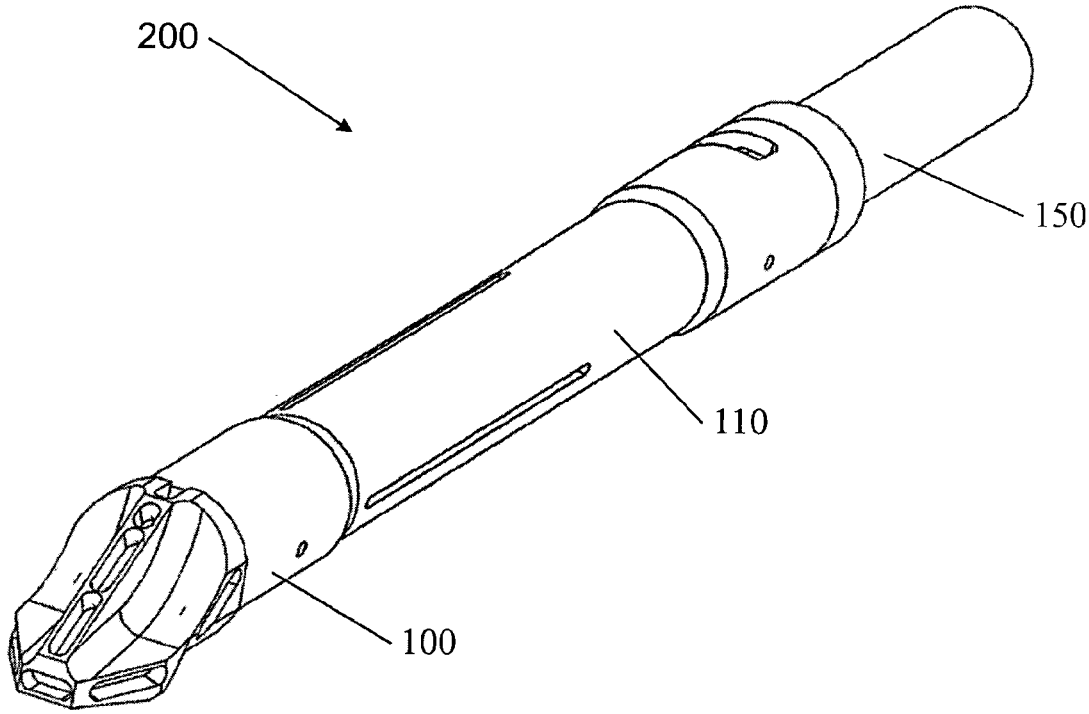
FIG. 2 shows an isometric view of a drill assembly according to an embodiment of the invention.
Figure 3A:
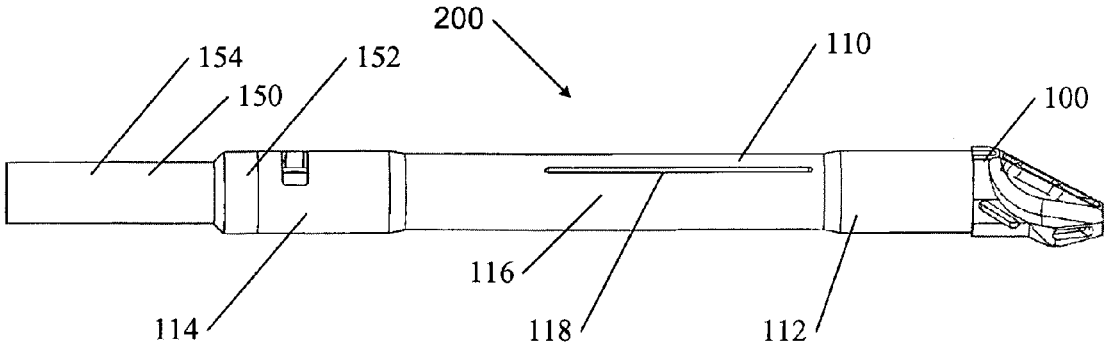
FIG. 3A shows a side view of a drill assembly according to an embodiment of the invention.

FIG. 2 shows a view of a drilling assembly 200 according to an embodiment of the invention. The assembly 200 includes a drill head 100 as described in embodiments above. A sonde housing 110 is coupled behind the drill head 100, and an adapter 150 is coupled behind the sonde housing 110. FIG. 3A shows a side view of the drilling assembly 200. The sonde housing 110 includes a front coupling portion 112 and a rear coupling portion 114 with a sonde receiving portion 116 between the front coupling portion 112 and the rear coupling portion 114. In one embodiment, the sonde receiving portion 116 includes a number of signal transparent regions 118 that allow signals from the sonde to transmit from within the sonde housing 110. The adapter 150 includes a sonde connecting portion 152 and a drill string connecting portion 154. In one embodiment, the drill string connecting portion 154 includes a tapered female thread. In one embodiment, the assembly 200 is attached to an end of a drill string (not shown) at the connecting portion 154. In one embodiment, the sonde connecting portion 152 includes a quick connect configuration similar to the configuration described in FIG. 1B.

Figure 3B:
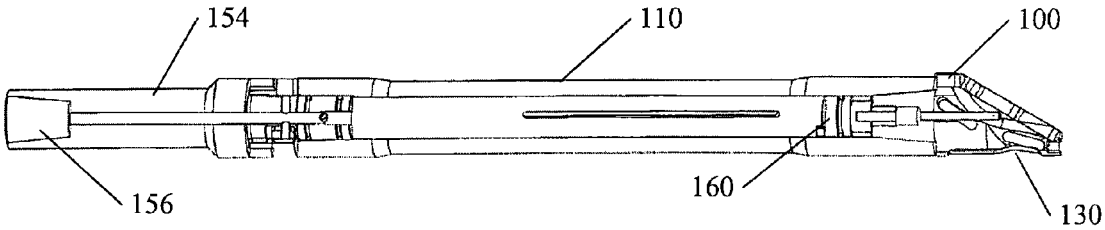
FIG. 3B shows a cross sectional view of FIG. 3A.

FIG. 3B shows a cross section of the drilling assembly 200. An alignment insert 160 is shown within the front coupling portion 112 of the sonde housing 110. In one embodiment, the alignment insert 160 keys the sonde in place to orient the drilling assembly 200 during operation. In one embodiment, during operation, liquid such as water, bentonite slurry, etc. flows through a center of the drill string, into the adapter 150 and into a peripheral portion of the sonde housing to avoid contaminating the sonde, which can contain expensive, easily damaged electronics. In one embodiment, the liquid then flows back to the center of the alignment insert 160, and into the drill head 100. In one embodiment, the alignment insert 160 is a separate component that is coupled to the drill head 100. In one embodiment an alignment feature is integrally formed as part of the drill head 100. As discussed above, in one embodiment, the liquid is then ported out of the drill head in a direction that is not parallel to the axis of drilling. Using combinations of features listed above, steering of the drill is aided by the use of liquid during a drilling operation.

Figure 4:
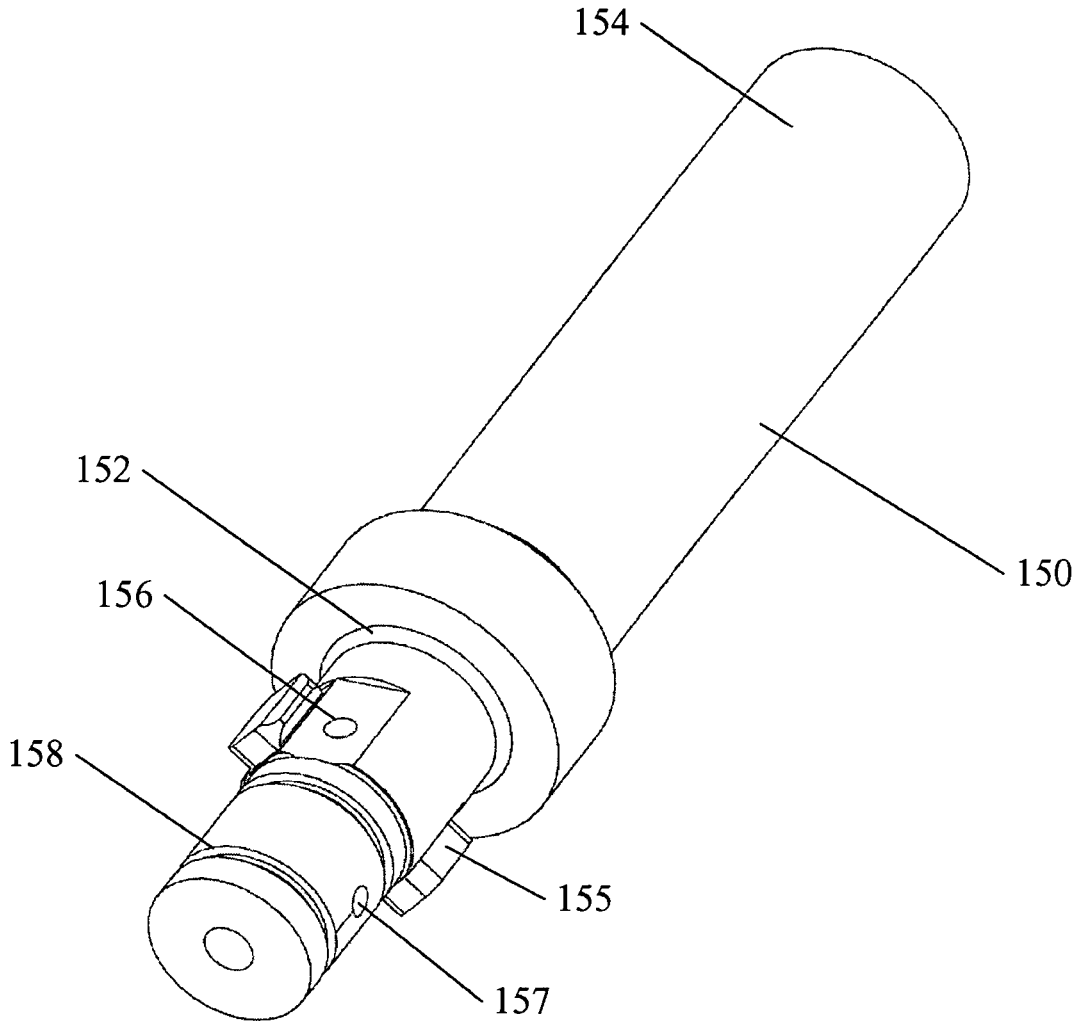
FIG. 4 shows an isometric view of a component of a drill assembly according to an embodiment of the invention.

FIG. 4 shows one embodiment of an adapter 150. A first engaging feature 155 and a second engaging feature 156 are shown for coupling to the sonde housing 110. Although a pair of engaging features are shown, the invention is not so limited. A single feature or multiple features are also within the scope of the invention. An adapter port 157 is shown adjacent to a number of O-ring seal slots 158. In one embodiment, as discussed above, liquid passes through the adapter port 157 into a peripheral portion of the sonde housing 110.

In one embodiment, a threaded hole 156, or other fastener component is located adjacent to the engaging features 155, 156. In one embodiment, after the engaging features 155, 156 are mated into corresponding features such as slots in the sonde housing 110, a fastener is inserted into the threaded hole 156. In one embodiment, a slot in the sonde housing or other component includes two directions of travel, such as an "L" shape. When the fastener (not shown) is inserted into the threaded hole, the fastener prevents the engaging features 155, 156 from rotating out of the corresponding slot. In one embodiment, the fastener is further inserted through a cover piece that protects the slot from filling up with ground debris, dirt, etc.

CONCLUSION

Embodiments of drill stem elements and connections as described above have a number of advantages. Features including, but not limited to a narrow front portion, a sharp hardened insert such as a carbide point, a curved rear portion of the drill head, etc. provide a drill head and drilling assembly with improved steering. Angled porting of liquid during a drilling operation also enhances steering of the drill head. Porting of liquid within a recess portion also enhances steering of the drill head. Features such as these are especially useful in difficult ground conditions such as dry and compacted soils such as can be found in southern California.

While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A drill head, comprising:

a number of hardened inserts secured to a drill head body including an edge insert pointing forward from a front portion of the drill head body;

a laterally tapered front portion of the drill head body;

a substantially vertically flat front portion of the drill head body; and a curved portion of the drill head body that curves rearwardly and upwardly away from the substantially vertically flat front portion to a top portion of the drill head body.

2. The drill head of claim 1, further including at least one fluid port that directs fluid at an angle from the direction of drilling.

3. The drill head of claim 2, wherein the at least one fluid port directs fluid substantially perpendicular to the direction of drilling.

4. The drill head of claim 2, wherein the at least one fluid port is located in a recess in a bottom portion of the drill head.

5. A drill head, comprising:

a drill head body, including a top portion, a bottom portion, side portions, and a leading edge, the leading edge being located adjacent to the bottom portion, the drill head body including:

a tapered portion tapering rearwardly and laterally from the leading edge to the side portions;

a flat portion, adjacent to the leading edge and substantially parallel to the bottom portion of the drill head body, the flat portion extending along the tapered portion and rearwardly from the leading edge; and a steering surface that transitions between the flat portion and the top portion of the drill head body; and a number of hardened inserts secured to the drill head body including an elongated insert with an edge pointing forward from the leading edge of the drill head body.

6. The drill head of claim 5, wherein the steering surface that transitions between the flat portion and the top portion of the drill head body includes a steering surface with a concave curve between the flat portion and the top portion of the drill head body.

7. The drill head of claim 5, further including a center portion raised from at least a portion of the steering surface that transitions between the leading edge and the top portion of the drill head body.

8. The drill head of claim 7, wherein the center portion includes a number of elongated inserts.

9. The drill head of claim 5, further including a quick connect fastening portion to couple to a section of drill stem.

10. A drill head, comprising:

a leading edge located at a bottom portion of the drill head;

a steering surface extending from the leading edge backwards and up toward a top portion of the drill head; and at least one fluid port recessed within a bottom surface of the drill head behind the leading edge, the at least one fluid port directing fluid at least partially downward at an angle away from a drill stem axis.

11. The drill head of claim 10, wherein multiple fluid ports are recessed within the drill head.

12. The drill head of claim 10, wherein the fluid port directs fluid at a substantially perpendicular angle to the drill stem axis.

13. A drill head, comprising:

a drill head body, including a top portion, a bottom portion, side portions, and a leading edge, the leading edge being located adjacent to the bottom portion, the drill head body including:

a tapered portion tapering rearwardly and laterally outwardly from the leading edge to the side portions;

a flat portion, adjacent to the leading edge and substantially parallel to the bottom portion of the drill head body, the flat portion extending along the tapered portion and rearwardly from the leading edge;

a center portion that transitions between the leading edge and the top portion of the drill head body; and a steering surface that transitions between a back of the flat portion to the top portion of the drill head body, wherein the center portion is raised from at least a portion of the steering surface; and a number of hardened inserts secured to the drill head body including an elongated insert with an edge pointing forward from the leading edge of the drill head body.

14. The drill head of claim 13, wherein the steering surface that transitions between the flat portion and the top portion of the drill head body includes a steering surface with flat transition between the flat portion and the top portion of the drill head body.

15. The drill head of claim 13, wherein the steering surface that transitions between the flat portion and the top portion of the drill head body includes a steering surface with a concave curve between the flat portion and the top portion of the drill head body.

16. A drill head, comprising:

a drill head body, including a top portion, a bottom portion, side portions, and a leading edge, the leading edge being located adjacent to the bottom portion, the drill head body including:

a tapered portion tapering rearwardly and laterally outwardly from the leading edge to the side portions;

a flat portion, adjacent to the leading edge and substantially parallel to the bottom portion of the drill head body, the flat portion extending along the tapered portion and rearwardly from the leading edge;

a center portion that transitions between the leading edge and the top portion of the drill head body; and a steering surface that curves upwardly and rearwardly from a back of the flat portion to the top portion of the drill head body, wherein the center portion raised from at least a portion of the steering surface;

a number of hardened inserts secured to the drill head body including an elongated insert with an edge pointing forward from the leading edge of the drill head body; and at least one fluid port that directs fluid at an angle away from a drill stem axis.

17. The drill head of claim 16, wherein the fluid port is recessed within a bottom surface of the drill head.

18. The drill head of claim 17, wherein the fluid port directs fluid at a substantially perpendicular angle to the drill stem axis.

19. The drill head of claim 16, further including a quick connect fastening portion to couple to a section of drill stem.

* * * * *